US005385663A

United States Patent [19]

Zimmerman et al.

[11] Patent Number: 5,385,663

[45] Date of Patent: Jan. 31, 1995

[54] INTEGRATED HYDROCRACKING-CATALYTIC DEWAXING PROCESS FOR THE PRODUCTION OF MIDDLE DISTILLATES

[75] Inventors: Joseph E. Zimmerman, Arlington Heights; Edward C. Haun, Glendale Hts., both of Ill.

[73] Assignee: UOP, Des Plaines, Ill.

[21] Appl. No.: 900,402

[22] Filed: Jun. 18, 1992

[51] Int. Cl.[6] ..... C10G 67/00

[52] U.S. Cl. ..... 208/58; 208/59; 208/111

[58] Field of Search ..... 208/59, 58

[56] References Cited

U.S. PATENT DOCUMENTS

| | | | |
|---|---|---|---|
| 3,647,678 | 3/1972 | Egan | 208/59 |
| 3,730,876 | 5/1973 | Sequeira, Jr. | 208/59 |
| 4,159,935 | 7/1979 | Scott | 208/59 |
| 4,283,271 | 8/1981 | Garwood et al. | 208/59 |
| 4,347,121 | 8/1982 | Mayer et al. | 208/59 |
| 4,414,097 | 11/1983 | Chester et al. | 208/59 |
| 4,574,043 | 3/1986 | Chester et al. | 208/59 |
| 4,648,958 | 3/1987 | Ward | 208/59 |
| 4,743,354 | 5/1988 | Ward | 208/59 |
| 4,743,355 | 5/1988 | Ward | 208/59 |
| 4,773,987 | 9/1988 | Garwood et al. | 208/59 |
| 4,810,356 | 3/1989 | Gratjan et al. | 208/59 |
| 4,935,120 | 6/1990 | Lipinski et al. | 208/59 |
| 4,960,504 | 10/1990 | Pellet et al. | 208/411 |

OTHER PUBLICATIONS

N. Choudhary and D. N. Saraf, "Hydrocracking: A Review," *Ind. Eng. Chem. Prod. Res. Dev.*, pp. 74–83, vol. 14, Nov. 2, 1975.

N. Y. Chen et al., "New process cuts pour point of distillates," *The Oil and Gas Journal*, pp. 165–170, Jun. 6, 1977.

N. Y. Chen and William E. Garwood, "Selective Hydrocracking of n-Paraffins in Jet Fuels," *Ind. Eng. Chem. Process Des. Dev.*, pp. 513–518, vol. 17, No. 4.

*Primary Examiner*—Helane Myers

*Attorney, Agent, or Firm*—Thomas K. McBride; John F. Spears, Jr.

[57] ABSTRACT

A diesel or jet fuel distillate product is recovered from a hydrocracking process in an integrated flowscheme wherein the distillate is removed from the hydrocracking zone product column and then passed into a catalytic dewaxing zone. The once-through hydrogen provided in the catalytic dewaxing zone is the makeup hydrogen for the hydrocracking zone. Large economies are realized in terms or reduced capital costs compared to the conventional flowscheme. In addition the severity of the hydrocracking operation is reduced thus extending the life of the hydrocracking catalyst.

3 Claims, 1 Drawing Sheet

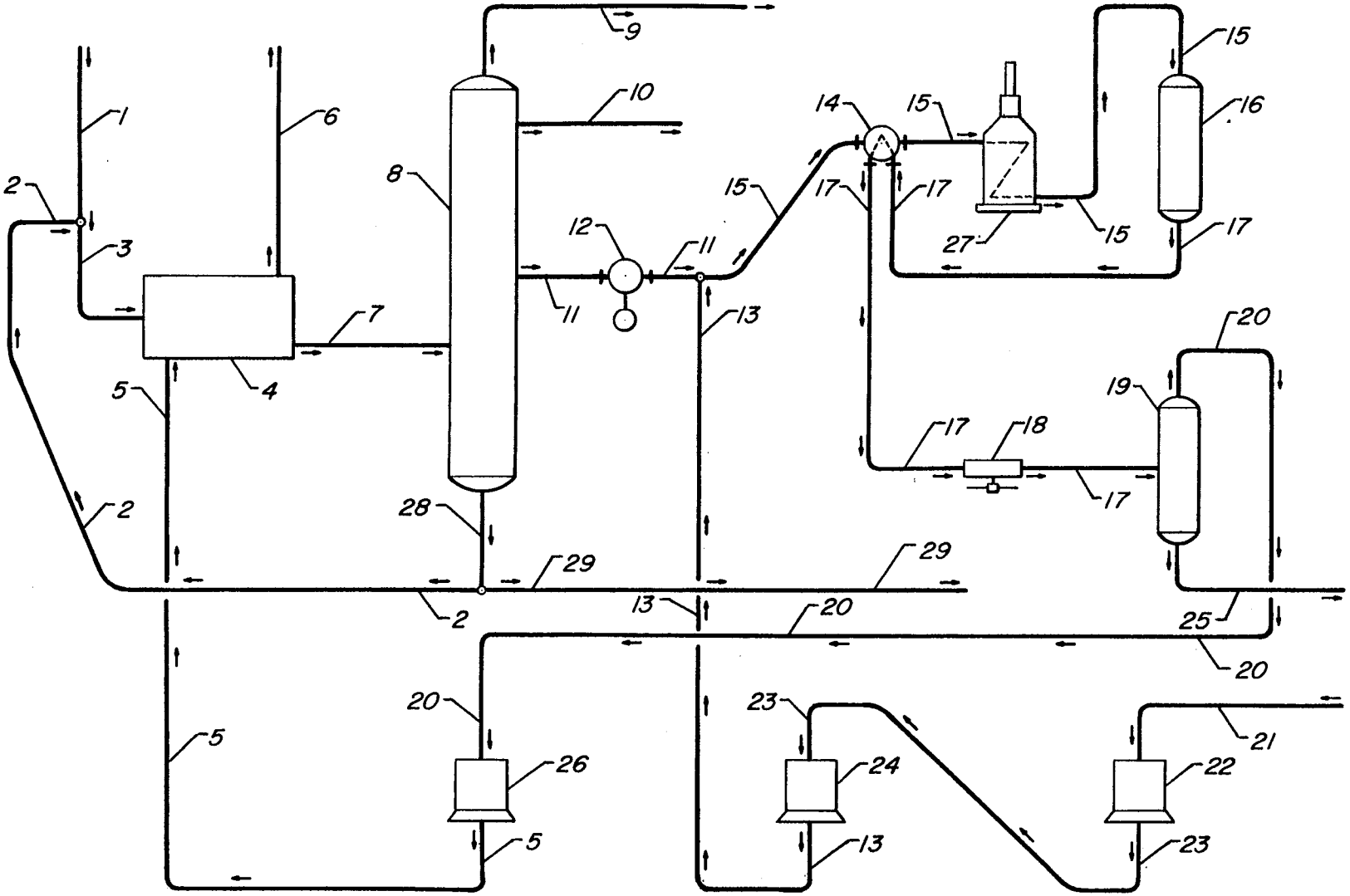
1
2
3
4
5
6
7
8
9
10
11
12
13
14
15
16
17
18
19
20
21
22
23
24
25
26
27
28
29

INTEGRATED HYDROCRACKING-CATALYTIC DEWAXING PROCESS FOR THE PRODUCTION OF MIDDLE DISTILLATES

BACKGROUND OF THE INVENTION

The invention relates to a hydrocarbon conversion process useful for upgrading heavy distillates and residual petroleum fractions into more valuable middle distillate products via hydrocracking and catalytic dewaxing. More specifically, the invention relates to a process flow wherein a portion of the middle distillates produced in a hydrocracking zone are subjected to catalytic dewaxing to decrease their pour points

PRIOR ART

A hydrocracking process unit is widely used in petroleum refineries for converting and upgrading a heavy distillate or a black oil to more useful and valuable lighter distillate products. A review of hydrocracking catalysts, processing applications and flow schemes is provided in a paper by N. Choudhary et al. published at page 74 of *Industrial Engineering & Chemistry,* Prod. Res. Dev., Vol. 14, No. 2, 1975. This reference is also pertinent for its description of various hydrocracking process flows including the use of product recovery columns.

The use of selective catalytic reactions to reduce the pour point of distillates has been described in the literature. For instance the article by N. Y. Chen and W. E. Garwood (Ind. Eng. Chem. Process Des. Dev., Vol 17, No. 4, 1978 at page 513) discloses the selective hydrocracking of normal paraffins in kerosene type jet fuels over metal loaded erionite, X and A zeolites. The article appearing at page 165 of the Jun. 6, 1977 issue of The Oil and Gas Journal entitled "New Process cuts pour points of distillates" illustrates that it is known to apply catalytic techniques to change distillate product qualities. This article is also relevant for its showing in FIG. 3 of an integration of the distillate dewaxing reactor with a desulfurization reactor.

U.S. Pat. No. 4,960,504 issued to R. J. Pellet et al discloses the use of catalysts containing a nonzeolitic molecular sieve silicoaluminophosphate (SAPO) material for the catalytic dewaxing of a variety of hydrocarbon fractions including jet fuel, diesel fuel and kerosene. It is indicated this catalyst may contain a metal hydrogenation component such as platinum or palladium.

BRIEF SUMMARY OF THE INVENTION

The invention is a hydrocracking process which includes a catalytic dewaxing step. The inventive concept resides in the manner in which hydrogen is passed into the catalytic dewaxing zone and then recovered for use in the hydrocracking reaction zone. The invention greatly reduces the capital costs of building the combined hydrocracking-dewaxing complex as compared to building separate unintegrated units.

One broad embodiment of the invention may be characterized as a hydrocarbon conversion process which comprises the steps of passing a feed stream comprising a complex mixture of hydrocarbonaceous compounds having boiling points above about 370 degrees centigrade into a hydrocracking reaction zone operated at hydrocracking conditions and producing a hydrocracking zone effluent stream comprising normally liquid distillate product hydrocarbons; passing the hydrocracking zone effluent stream into a fractionation zone operated at conditions effective to separate entering hydrocarbons into a plurality of product streams including at least one middle distillate side cut stream having a boiling point range between about 232 and about 450 degrees centigrade, admixing a first hydrogen rich gas stream with the distillate sidecut stream and passing the resultant admixture into a catalytic dewaxing zone operated at dewaxing conditions and producing a dewaxing zone effluent stream; recovering a second hydrogen rich gas stream from the dewaxing zone effluent stream; compressing the second hydrogen rich gas stream and passing the second hydrogen rich gas stream into said hydrocracking zone as a makeup hydrogen gas stream charged to the hydrocracking zone.

BRIEF DESCRIPTION OF THE DRAWING

The drawing is a simplified process flow diagram showing a feed stream 1 entering a hydrocracking reaction zone 4, a product fractionation column 8 and a dewaxing reactor 16 receiving once-through hydrogen from the hydrocracking zone makeup gas compressors 22 and 24.

DETAILED DESCRIPTION

Processes are known for upgrading essentially any heavy feedstock into more valuable light and middle distillate products such as gasoline, kerosene, jet fuel and diesel fuel. However, significant challenges remain in developing economically competitive processes which lower the cost of the conversion. It is an objective of the subject invention to provide one such process wherein residual feedstocks are converted to higher value middle distillate products. Another objective of the subject invention is to reduce the capital cost and operating cost (utilities cost) required to produce middle distillate cuts, specifically diesel fuel, recoverable from a hydrocracking process. Other objectives of the invention are to increase the amount of diesel fuel and/or jet fuel recovered from a hydrocracking process unit without changes in the operation of the hydrocracking reactor or alternatively to reduce the severity of the operation of the hydrocracking reactor.

The higher value of middle distillates as compared to available residual and heavy distillate feeds provides an economic incentive for the conversion of these available charge stocks as by hydrocracking. These middle distillate products have several quality specifications including boiling range, sulfur content, etc. and compliance with the product specifications often limits the relative amounts of reaction products which can be included in a given product stream recovered from the hydrocracking zone. One instance of the product specification limiting the recovery of the desired distillates is the increase of the pour point of heavy diesel fuel caused by raising the end boiling point of the heavy diesel fraction withdrawn from the product recovery column of a hydrocracking unit. It has been found that increasing the endpoint of the diesel product or including more heavy products is often prohibited by the pour point specification for the diesel fuel. Thus the material boiling above the endpoint effectively set by the pour point must be recycled to the hydrocracking reactor for further conversion. This recycling is costly and reduces the effective capacity of the hydrocracking unit.

While it has been recognized that catalytic dewaxing could be applied in this situation to reduce the pour point of a diesel fraction, this approach has not been followed commercially because of the prohibitively high cost of the required stand-alone catalytic dewaxing process unit. The high cost of these units was estimated to make their construction impractical. A large portion of the cost of the preferred catalytic dewaxing process is related to the hydrogen recirculation, makeup and gas purification facilities and product stripping column that are required. For instance, it is required to include recycle gas scrubbing to prevent hydrogen sulfide from deactivating the catalyst. Product stripping and drying facilities are also required to remove light ends and water produced in the process. Conforming to the objectives set out above the subject invention addresses these factors leading to high capital and operating costs. Cost estimates indicate the subject invention reduces the simple payback time for a catalytic dewaxing zone on a 20,000 barrel per day hydrocracking unit from over 6 years to less than 3 years.

In a conventional hydrocracking process the reaction zone effluent is removed from the final catalyst bed, heat exchanged with the feed to the reaction zone and then passed into a vapor-liquid separation zone often referred to as a high pressure separator. Additional cooling can be done prior to this separation. In some instances a hot flash separator is used upstream of the high pressure separator. The vapor phase from the separator(s) is further cooled to remove additional hydrocarbons and if desired treated to remove hydrogen sulfide prior to use as recycle gas. The product recovery steps may also comprise use of an optional "cold" low pressure flash separator to produce a final liquid phase product. The liquid phase recovered from the reaction zone is customarily passed into a product fractionation zone. These recovery steps and the contacting of the charge stock with the hydrocracking catalyst are performed in a collection of equipment referred to herein as the "hydrocracking zone".

The subject invention minimizes the equipment needed to perform catalytic dewaxing of a middle distillate product stream recovered from a hydrocracking zone by integrating the two reaction zones via the hydrogen gas flow of the resulting overall process. The manner in which this is accomplished is illustrated in the drawing. A hydrocracking zone feed stream comprising a heavy distillate fraction or a residual fraction or a mixture of several such fractions is passed into the hydrocracking zone 4 via lines 1 and 3. Also passed into the hydrocracking zone 4 are recycled unconverted hydrocarbons from line 2 and a hydrogen rich makeup gas stream carried by line 5. The hydrogen-rich recycle stream circulates with the hydrocracking zone 4 and thus is not represented on the drawing.

As used herein the term" rich" is intended to refer to a concentration of the indicated compound or class of compounds equal to greater than 50 mole percent and preferably greater than 75 mole percent. In the hydrocracking zone the feed stream is contacted with one or more beds of hydrocracking catalyst, which may be in a single reactor or a series or two or more reactors. The exact configuration of the hydrocracking reactors and initial product separation equipment does not form a part of the invention and may be varied as required or appropriate in the circumstances. The hydrocracking reaction is not totally specific and some light hydrocarbon byproducts will be produced. These will removed from the hydrocracking zone via a light off gas stream carried by line 6. The main liquid phase product recovered from the reaction zone is passed through line 7 into a product recovery column 8. This column is designed and operated to separate entering hydrocarbons into at least a net overhead stream removed in line 9, a naphtha boiling range sidecut stream removed via line 10, one or more middle distillate sidecut stream(s), such as the diesel boiling range stream of line 11, and a net bottoms stream of line 28. The net bottoms stream is divided into a recycle stream of line 2 and a smaller drag stream of line 29, which may be removed from the process or passed into another process unit.

The diesel sidecut stream of line 11 is pressurized in a pump 12 and admixed with a hydrogen rich substantially sulfur free gas stream carried by line 13. This admixture is carried by line 15 through an indirect heat exchanger 14 and a fired heated 27 which heats the sidecut stream up to the desired inlet temperature of the catalytic dewaxing reactor 16. The diesel boiling range sidecut is then passed through the reactor wherein it is contacted with a suitable dewaxing catalyst maintained at dewaxing conditions. This produces a dewaxing zone effluent stream carried by line 17 which is first cooled in the feed-effluent heat exchanger 14 and then further reduced in temperature in the cooler 18. The effluent stream is then passed into a vapor-liquid separation zone 19 in which it is separated into a hydrogen rich vapor stream carried by line 20 and diesel product stream carried by line 25. This sidecut stream is preferably passed into a conventional sidecut stripper to remove light ends dissolved in it, with the light ends being returned to the product column 8 by a line not shown. Those skilled in the art will appreciate that the stripping column normally used on the hydrocracking unit product recovery column will function adequately. This is a sizeable advantage as the cost of the process is thus greatly reduced.

The hydrogen consumed in the hydrocracking reaction zone is replaced by the substantially sulfur-free hydrogen makeup gas stream charged to the process in line 21. This gas stream is assumed to be at a low pressure which requires three stages of compression to economically raise it to the desired hydrocracking conditions. It therefore is passed into a first compressor 22. The effluent of the compressor will normally be passed through a cooler and liquid knock drum both of which are not shown for simplicity. The net gas from the first stage compressors is then passed into a second stage compressor 24 via line 23. The required amount of the effluent gas of the second stage makeup compressor is passed via line 13 into line 11 to supply the hydrogen required in dewaxing reactor 16. Any excess hydrogen flows through a line not shown to compressor 26. Substantially all of the hydrogen is recovered as the net gas stream of line 20, which is passed into the third stage makeup gas compressor 26.

If the makeup hydrogen is available at an elevated pressure or if the hydrocracking zone is operated at a low pressure only two stages of makeup gas compression may be desired. It is contemplated that the invention could be practiced in a process employing only two makeup gas compressors. The hydrogen charged to the dewaxing zone is then removed from the first stage of compression.

While it is a major purpose of the invention to reduce the entrance of hydrogen sulfide into the catalytic dewaxing zone, it must be recognized that the convenient provision of a hydrogen-rich gas free of hydrogen sulfide will by itself not prevent the entrance of hydrogen sulfide into the dewaxing reactor 16 if hydrogen sulfide is present in the hydrocarbon feed to the reactor. Hydrogen sulfide entering the product fractionation column 8 will be present to an extent set by the conditions within the column at the drawoff point in the sidecut stream(s) removed from the product fractionation column. The provision of an upstream stripping column or other equipment such as adsorbents would eliminate the presence of hydrogen sulfide in the sidecut stream.

Those skilled in the art will recognize that numerous pieces of process equipment and ancillary apparatus are not illustrated on the drawing. For instance, for clarity in presenting the overall flow the drawing does not illustrate the interstage coolers and knock out drums which are employed between the compressors 22 and 24. The drawing also does not illustrate the placement of monitoring equipment, flow control systems, the feed heater and overhead system required on the fractionation zone 8 and other equipment. Such equipment may be of customary nature.

The subject process is especially useful in the production of middle distillate fractions boiling in the range of about 300°–700° F. (149°–371° C.) as determined by the appropriate ASTM test procedure. The term "middle distillate" is intended to include the diesel, jet fuel and kerosene boiling range fractions. The kerosene boiling point range is intended to refer to about 300°–450° F. (149°–232° C.) and diesel boiling range is intended to refer to hydrocarbon boiling points of about 450°–about 700° F. (232°–371° C.). Gasoline is normally the $C_5$ to 400° F. (204° C.) endpoint fraction of available hydrocarbons. The boiling point ranges of the various product fractions will vary depending on specific market conditions, refinery location, etc. One common variation is the production of light and heavy naphtha fractions.

The hydrocracking reactions occurring in the hydrocracking zone will reduce the average molecular weight of the feed stream hydrocarbons resulting in the production of gasoline and middle distillate (kerosene and diesel fuel) boiling range hydrocarbons and some lighter but also valuable by-products such as LPG. In addition, other useful hydroprocessing reactions such as hydrodenitrification and hydrodesulfurization will occur simultaneously with hydrocracking of the feedstock. This leads to the production of hydrogen sulfide and ammonia and their presence in the hydrocracking zone effluent stream.

Typical feedstocks include virtually any heavy mineral oil and fractions thereof. Thus, such feedstocks as straight run gas oils, vacuum gas oils, demetallized oils, deasphalted vacuum residue, coker distillates, cat cracker distillates, shale oil, tar sand oil, coal liquids, and the like are contemplated. The preferred feedstock will have a boiling point range starting at a temperature above 160° Celsius but would not contain appreciable asphaltenes. It is preferred that less than about 25 volume percent of the hydrocarbons in the feed stream have boiling points below about 240 degrees C. Feedstocks with end boiling points under about 830° F. (443° C.) are preferred. Preferred feedstocks include gas oils having at least 50% volume of their components boiling above 700° F. (371° C.). The feedstock may contain nitrogen usually present as organonitrogen compounds in amounts between 1 ppm and 1.0 wt. %. The feed will normally contain sulfur-containing compounds sufficient to provide a sulfur content greater than 0.15 wt. %. It may also contain mono- and/or polynuclear aromatic compounds in amounts of 50 volume percent and higher.

Hydrocracking conditions employed in the subject process are those customarily employed in the art for hydrocracking equivalent feedstocks. Hydrocracking reaction temperatures are in the range of 400° to 1200° F. (204°–649° C.), preferably between 600° and 950° F. (316°–510° C.). Reaction pressures are in the range of atmospheric to about 3,500 psi (24,233 kPa), preferably the hydrogen partial pressure is between 1000 and 2000 psi (6,895–13,790 kPa). Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178–8,888 std. $m^3/m^3$), preferably between 5,000 and 30,000 scf per barrel of charge (887–5,333 std. $m^3/m^3$).

The subject process is not restricted to the use of a specific hydrocracking catalyst° Different types of hydrocracking catalysts can therefore be employed effectively in the subject process. For instance, the metallic hydrogenation components can be supported on a totally amorphous base or on a base comprising an admixture of amorphous and zeolitic materials. The nonzeolitic hydrocracking catalysts will typically comprise a support formed from silica-alumina and alumina. In some instances, a clay is used as a component of the nonzeolitic catalyst base. Suitable catalysts may be purchased from several manufacturers.

Many hydrocracking catalysts are prepared using a starting material having the essential X-ray powder diffraction pattern of zeolite Y set forth in U.S. Pat. No. 3,130,007. A zeolitic starting material may be modified by techniques known in the art which provide a desired form of the zeolite. Thus, the use of zeolite modification techniques such as hydrothermal treatment at increased temperatures, dealumination and calcination is contemplated. A Y-type zeolite preferred for use in the present invention preferably possesses a unit cell size between about 24.20 Angstroms and 24.45 Angstroms. More preferably the zeolite unit cell size will be in the range of about 24.20 to 24.40 Angstroms and most preferably about 24.30 Angstroms. The zeolite is preferably a stabilized or ultrastable Y zeolite. The catalyst may comprise an admixture of two modified Y zeolites such as described in U.S. Pat. No. 4,661,239. The zeolite may be treated to increase its silica to alumina ratio by insertion of silica as described in U.S. Pat. Nos. 4,576,711 and 4,503,023 and in European Patent Application 88-361660 assigned to Akzo NV. The use of a zeolite having a silica-alumina framework ratio above 8.0 is preferred.

A zeoitic type hydrocracking composite containing no amorphous material can be produced but it is preferred that zeolitic catalysts contain between 2 wt. % and 20 wt. % of the Y-type zeolite, and more preferably between 2 wt. % and 10 wt. %. The zeolitic catalyst composition should also comprise a porous refractory inorganic oxide matrix which may form between 2 and 98 wt. %, and preferably between 5 and 95 wt. % of the support of the finished catalyst composite. The matrix may comprise any known suitable refractory inorganic oxide such as alumina, magnesia, silica, titania, zirconia, silica-alumina and the like and combinations thereof which are suitable as hydrocracking catalyst components. A preferred matrix comprises silica-alumina or alumina. The most preferred matrix comprises a mixture of silica-alumina and alumina wherein said silica-alumina comprises between 5 and 45 wt. % of said matrix. It is also preferred that the support comprises from about 5 wt. % to about 45 wt. % alumina.

A silica-alumina component may be produced by any of the numerous techniques which are well defined in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier, commonly defined in terms of surface area, pore diameter and pore volume, may be developed to specified limits by any suitable means including aging a hydrosol and/or hydrogel under controlled acidic or basic conditions at ambient or elevated temperature, or by gelling the carrier at a critical pH or by treating the carrier with various inorganic or organic reagents.

A finished catalyst for utilization in the hydrocracking zone should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2$/gm are greatly preferred.

The precise physical characteristics of the catalyst such as shape and surface area are not considered to be limiting upon the utilization of the present invention. The catalyst may, for example, exist in the form of pills, pellets, granules, broken fragments, spheres, or various special shapes such as trilobal extrudates, disposed as a fixed bed within a reaction zone. Alternatively, the catalyst may be prepared in a suitable form for use in moving bed reaction zones in which the hydrocarbon charge stock and catalyst are passed either in countercurrent flow or in co-current flow. Another alternative is the use of fluidized or ebulated bed reactors in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed into the reactors and in either upward or downward flow. The catalyst particles may be prepared by any known method in the art including the well-known oil drop and extrusion methods.

Further information on the preparation of suitable hydrocracking catalysts may be obtained by reference to U.S. Pat. Nos. 4,422,959; 4,576,711; 4,661,239; 4,686,030; and, 4,695,368 which are incorporated herein by reference.

The catalytic dewaxing step can be performed in a downflow or trickle bed reactor in which the middle distillate fraction is contacted with a fixed bed of dewaxing catalyst. This operation is performed at dewaxing conditions which depend upon the composition of the feed material, the activity of the dewaxing catalyst and the desired reduction in pour point. A general range of dewaxing conditions include a temperature between about 200 and 450 degrees centigrade, preferably between 300 and 400 degrees centigrade, and a pressure of about 500 and 1500 psig (3450 and 10340 k Pa). This pressure will normally be several hundred psig lower than the pressure in the hydrocracking reaction zone. The dewaxing reaction zone will be operated at a liquid hourly space velocity (LHSV) of from about 0.1 to about 10, with a range of from 0.5 to 2.0 being preferred. The maximum amount of hydrogen present in the dewaxing reactor is set by the flow rate of the makeup hydrogen gas stream charged to the hydrocracking zone. The total amount of gas charged to the dewaxing reactor will therefore be quite low compared to the total amount of gas charged to the hydrocracking reactors. This is compensated for somewhat by the relatively smaller amount of middle distillate being processed, which is only a fraction of the total output of the hydrocracking zone. In fact it is expected that it will be necessary for only a portion of the hydrocracking zone makeup gas to be charged to the dewaxing reactor. The remainder will go to the final stage of compression. Dewaxing conditions employed in the subject invention include the presence of hydrogen in the general range of from about 178 to about 1244 std $m^3/m^3$ (1000 to 7000 std cubic feet per barrel).

A large number of dewaxing catalysts have been described in the prior art including those set out in U.S. Pat. Nos. 4,859,311; 4,880,760; 4,917,789; 4,836,910; 4,434,047 and 4,743,355. These patents are incorporated herein for their teaching as to the composition and usage of dewaxing catalysts.

A preferred dewaxing catalyst comprises a SAPO or MgAPSO nonzeolitic molecular sieve (NZMS) material. The above-cited U.S. Pat. No. 4,960,504 and U.S. Pat. No. 5,114,563 are incorporated herein for their description of SAPO dewaxing catalysts and their usage. This material will normally be present in the catalyst in admixture with other traditional catalyst matrix and binder components such as alumina and other commonly employed inorganic oxides. The catalyst will preferably contain between about 5 and about 35 wt. percent NZMS material. In addition the catalyst will preferably contain a catalytically effective amount of one or more metal component(s) generally referred to as a hydrogenation component selected from the members of Groups VIB and VIII of the American form of the Periodic Table as reproduced in the Chemical Engineer's Handbook, McGraw-Hill Book Company. Generally the catalyst may contain about 0.5 to about 2.5 wt percent of such a hydrogenation component, with the use of platinum and palladium being preferred.

The hereinafter described group of non-zeolitic molecular sieves are characterized in their calcined form by an adsorption of oxygen of at least 4 percent by weight at a partial pressure of 100 torr and a temperature of −186° C. The non-zeolitic molecular sieves are preferably characterized in their calcined form by an adsorption of isobutane of at least 2 percent by weight at a partial pressure of 500 torr and a temperature of 200° C. The non-zeolitic molecular sieves employed in the instant invention are most preferably characterized by one of the aforementioned adsorption criteria and also characterized by an adsorption of triethylamine from zero to less than 5 percent by weight, preferably less than 3 percent by weight, at a partial pressure of 2.6 torr and a temperature of 22° C.

The term "non-zeolitic molecular sieves" or "NZMS" is defined in the instant invention to include the "SAPO" molecular sieves of U.S. Pat. No. 4,440,871, "ELAPSO" molecular sieves as disclosed in U.S. Pat. No. 4,793,984 and certain molecular sieves as hereinafter described.

Crystalline metal aluminophosphates (MeAPOs where "Me" is at least one of Mg, Mn, Co and Zn) are disclosed in U.S. Pat. No. 4,567,029. "ELAPSO" molecular sieves are described in copending U.S. Ser. No. 600,312, filed Apr. 13, 1984, as crystalline molecular sieves having three-dimensional microporous framework structures of $ELO_2$, $AlO_2$, $PO_2$, $SiO_2$ oxide units and having an empirical chemical composition on an anhydrous basis expressed by the formula:

$$mR: (EL_wAL_xP_ySi_z)O_2$$

wherein "R" represents at least one organic templating agent present in the intracrystalline pore system; "m" represents the molar amount of "R" present per mole of $(EL_wAl_xP_ySi_z)O_2$ and has a value of from zero to about 0.3; "EL" represents at least one element capable of forming a three dimensional oxide framework, "EL" is characterized as an element having a mean "T-O" distance in tetrahedral oxide structures between about 1.51 Angstroms and about 2.06 Angstroms, "EL" has a cation electronegativity between about 125 kcal/g-atom to about 310 kcal/gm-atom and "EL" is capable of forming stable M-O-P, M-O-Al or M-O-M bonds in crystalline three-dimensional oxide structures having a "M-O" bond dissociation energy greater than about 59 kcal/g-atom at 298° K.; and "w", "x", "y" and "z" represent the mole fractions of "EL", aluminum, phosphorus and silicon, respectively, present as framework oxides. Silicoaluminophosphate molecular sieves are also described in U.S. Pat. No. 4,689,138.

The "ELAPSO" molecular sieves are also described as crystalline molecular sieves having three-dimensional microporous framework structures of $ELO_2$, $AlO_2$, $SiO_2$ and $PO_2$ tetrahedral oxide units and having an empirical chemical composition on an anhydrous basis expressed by the formula:

$$mR: (EL_wAL_xP_ySi_z)O_2$$

wherein "R" represents at least one organic templating agent present in the intracrystalline pore system; "m" represents the molar amount of "R" present per mole of $(EL_wAl_xP_ySi_z)O_2$ and has a value of from zero to about 0.3; "EL" represents at least one element capable of forming a framework tetrahedral oxide and is selected from the group consisting of arsenic, beryllium, boron, chromium, cobalt, gallium, germanium, iron, lithium, magnesium, manganese, titanium, vanadium and zinc; and "w" "x", "y" and "z" represent the mole fractions of "EL", aluminum, phosphorus and silicon, respectively, present as tetrahedral oxides The "ELAPSO" molecular sieves include numerous species which are intended herein to be within the scope of the term "non-zeolitic molecular sieves" such being disclosed in the following patents incorporated herein by reference thereto:

| PATENT NO. | NZ-MS |
|---|---|
| 4,744,970 | CoAPSO |
| 4,683,217 | FeAPSO |
| 4,758,419 | MgAPSO |
| 4,686,092 | MnAPSO |
| 4,684,617 | TiAPSO |
| 4,935,216 | ZnAPSO |

The MgAPSO molecular sieves of U.S. Pat. No. 4,758,419 have three-dimensional microporous framework structures of $MgO_2^{-2}$, $AlO^{-}_2$, $PO^{+}_2$ and $SiO_2$ tetrahedral oxide units and have an empirical chemical composition on an anhydrous basis expressed by the formula:

$$mR: (Mg_wAl_xP_ySi_z)O_2$$

wherein "R" represents at least one organic templating agent present in the intracrystalline pore system; "m" represents the molar amount of "R" present per mole of $(Mg_wAl_xP_ySi_z)O_2$ and has a value from zero (0) to about 0.3; and "w", "x", "y" and "z" represent the mole fractions of magnesium, aluminum, phosphorus and silicon, respectively, present as tetrahedral oxides and each preferably has a value of at least 0.01.

MgAPSO compositions are generally synthesized by hydrothermal crystallization for an effective time at effective pressures and temperatures from a reaction mixture containing reactive sources of magnesium, silicon, aluminum and phosphorus, an organic templating, i.e., structure-directing, agent, preferably a compound of an element of Group VA of the Periodic Table, and may be an alkali or other metal. The reaction mixture is generally placed in a sealed pressure vessel, preferably lined with an inert plastic material such as polytetrafluoroethylene and heated, preferably under autogeneous pressure at a temperature between 50° C. and 250° C., and preferably between 100° C. and 200° C. until crystals of the MGAPSO product are obtained, usually a period of from several hours to several weeks. Generally, the crystallization period will be from about 2 hours to about 30 days with it typically being from about 4 hours to about 20 days. MgAPSO materials are also described in U.S. Pat. No. 4,758,419.

One embodiment of the invention may accordingly be characterized as a hydrocarbon conversion process which comprises the steps of passing a first hydrogen rich gas stream and a hereinafter defined middle distillate stream having a boiling point range between about 232 and about 450 degrees centigrade into a catalytic dewaxing zone containing a bed of catalyst comprising a nonzeolitic molecular sieve operated at dewaxing conditions and producing a dewaxing zone effluent stream; recovering a middle distillate product stream and a second hydrogen rich gas stream from the dewaxing zone effluent stream; compressing the second hydrogen rich gas stream and passing a makeup hydrogen gas stream comprising at least the second hydrogen rich gas stream into a hydrocracking reaction zone wherein a feed stream is contacted with a hydrocracking catalyst at hydrocracking conditions and producing a hydrocracking zone effluent stream; and, separating the hydrocracking zone effluent stream into vapor and liquid fractions and passing said liquid fraction into a product recovery column wherein the liquid fraction is separated to produce a light and a middle distillate stream and passing the middle distillate stream into the catalytic dewaxing zone as the previously referred to middle distillate stream charged into the dewaxing zone.

What is claimed:

1. In a hydrocarbon conversion process which comprises the steps of:

a. passing a feed stream comprising a complex mixture of hydrocarbonaceous compounds having boiling points above about 370 degrees centigrade into a hydrocracking reaction zone operated at hydrocracking conditions and producing a hydrocracking zone effluent stream comprising normally liquid distillate product hydrocarbons;

b. passing the hydrocracking zone effluent stream into a fractionation zone operated at conditions effective to separate entering hydrocarbons into a plurality of product streams including at least one middle distillate stream having a boiling point range between about 232 and about 450 degrees centigrade, and c. admixing a substantially sulfur-free first hydrogen rich gas stream with the middle distillate stream and passing the resultant admixture into a catalytic dewaxing zone operated at dewaxing conditions and producing a dewaxing zone effluent stream; the improvement which comprises:

i. using a dewaxing catalyst comprising a SAPO or MgAPSO nonzeolitig molecular sieve and a hydrogenation component comprising palladium or platinum in the dewaxing step whereby the dewaxing zone effluent stream does not require stabilization by a sequential hydrotreatment;

ii. recovering a low sulfur second hydrogen rich gas stream from the dewaxing zone effluent stream; and iii. compressing the entire second hydrogen rich gas stream and passing the entire untreated second hydrogen rich gas stream into said hydrocracking zone as a makeup hydrogen gas stream charged to the hydrocracking zone.

2. The process of claim 1 wherein the nonzeolitic molecular sieve is a SAPO.

3. The process of claim 1 wherein the nonzeolitic molecular sieve is a MgAPSO.

* * * * *